US005358324A

United States Patent [19]

Liu

[11] Patent Number: 5,358,324

[45] Date of Patent: Oct. 25, 1994

[54] STATIONERY GOODS HOLDER AND BOOK SHELF COMBINATION

[76] Inventor: Zuo-Heng Liu, No. 61, Sec. 2, Tung Hsing Rd., Taichung, Taiwan

[21] Appl. No.: 4,850

[22] Filed: Jan. 19, 1993

[51] Int. Cl.[5] ..... A47B 41/06; A47B 81/00

[52] U.S. Cl. ..... 312/233; 312/290

[58] Field of Search ..... 312/290, 233; 40/358, 40/517, 515

[56] References Cited

U.S. PATENT DOCUMENTS

| | | | |
|---|---|---|---|
| 902,640 | 5/1911 | Byron | 312/233 |
| 1,997,585 | 4/1935 | Hunter | 312/233 X |
| 2,527,277 | 10/1950 | Schade | 312/233 X |
| 3,508,803 | 4/1970 | Redick | 312/233 |
| 3,714,890 | 6/1973 | Moon | 312/333 X |
| 4,269,381 | 5/1981 | Harms | 312/233 X |
| 4,411,482 | 10/1983 | Hoff | 312/233 |
| 4,913,502 | 4/1990 | Russell | 312/233 |
| 4,969,698 | 11/1990 | Maynard, Jr. | 312/233 X |

*Primary Examiner*—Kenneth J. Dorner
*Assistant Examiner*—Nancy Mulcare
*Attorney, Agent, or Firm*—Peterson, Wicks, Nemer & Kamrath

[57] ABSTRACT

A stationery goods holder includes a housing having one or more openings formed in the top, one or more drawers disposed in the upper portion for accommodating stationery goods, a number of bars laterally engaged in the side portion of the housing so as to form a book shelf. A number of shafts are rotatably supported in the housing, and a sheet material is wound on each of the shafts, the sheet materials can be pulled outwards of the housing for taking notes.

5 Claims, 3 Drawing Sheets

STATIONERY GOODS HOLDER AND BOOK SHELF COMBINATION

BACKGROUND OF THE INVENTION

1. Field of the Invention

The present invention relates to a book shelf, and more particularly to a stationery goods holder and book shelf combination.

2. Description of the Prior Art

Typical book shelves are good for supporting books only, and typical stationery goods holders are good for accommodating stationery goods only; the users have to buy one book shelf for holding books and buy another stationery goods holder for accommodating stationery goods, the users have to pay double cost, in addition, the two objects occupy a large space.

The present invention has arisen to mitigate and/or obviate the afore-described disadvantages of the conventional book shelves and stationery goods holders.

SUMMARY OF THE INVENTION

The primary objective of the present invention is to provide a stationery goods holder and book shelf combination which has a simplified configuration and occupies a small space.

In accordance with one aspect of the invention, there is provided a combination comprising a housing including at least one opening formed in top thereof, at least one drawer provided in an upper portion of the housing for accommodating stationery goods, a plurality of bars laterally engaged in a side portion of the housing and each including a first end engaged in the housing and a second end extended outward of the housing, a board fixed to the second ends of the bars so as to form a book shelf, whereby, the housing forms a stationery goods holder and includes a book shelf engaged in the side portion thereof for holding books.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
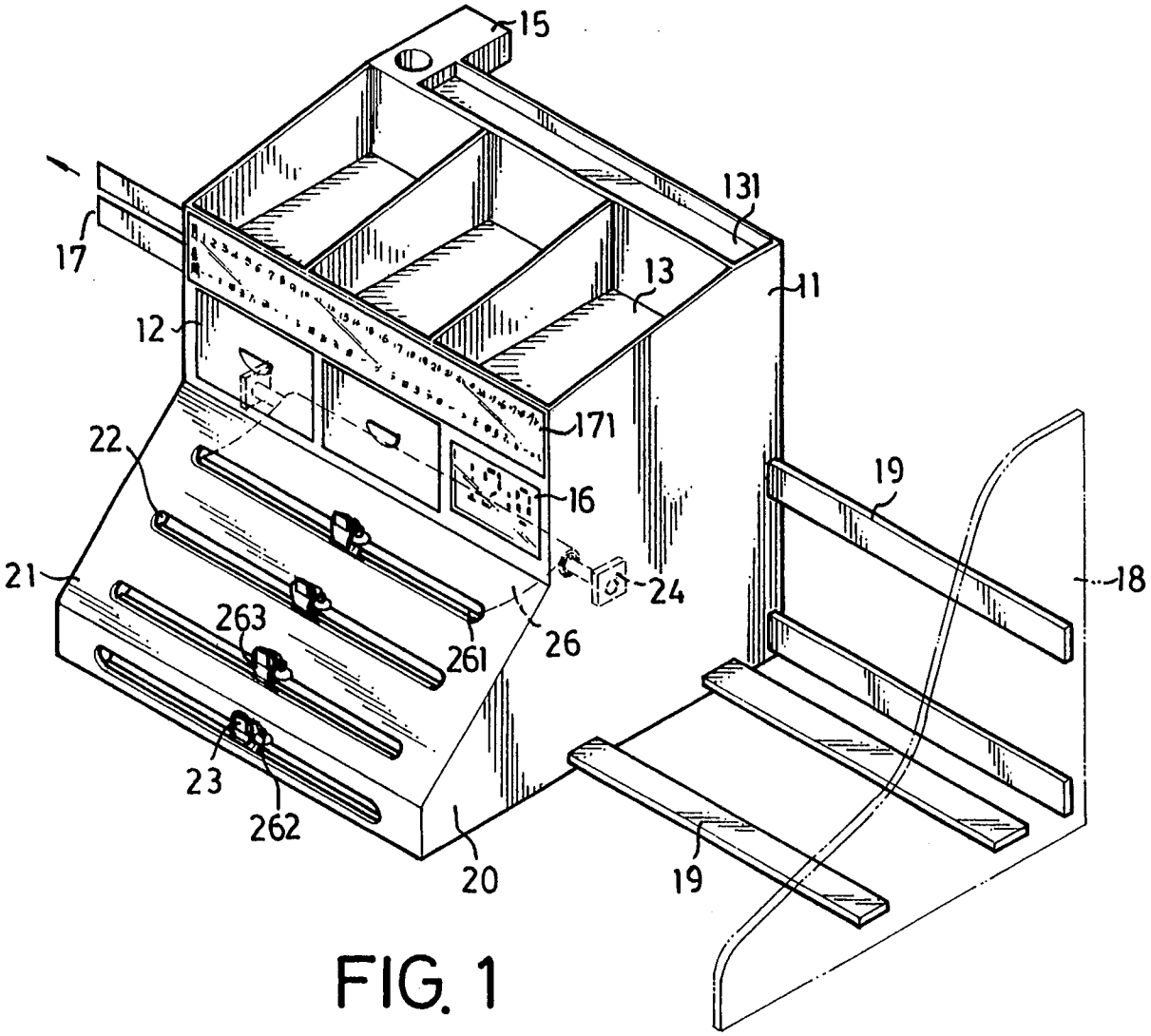
FIG. 1 is a perspective view of a stationery goods holder and book shelf combination in accordance with the present invention.
Figure 2:
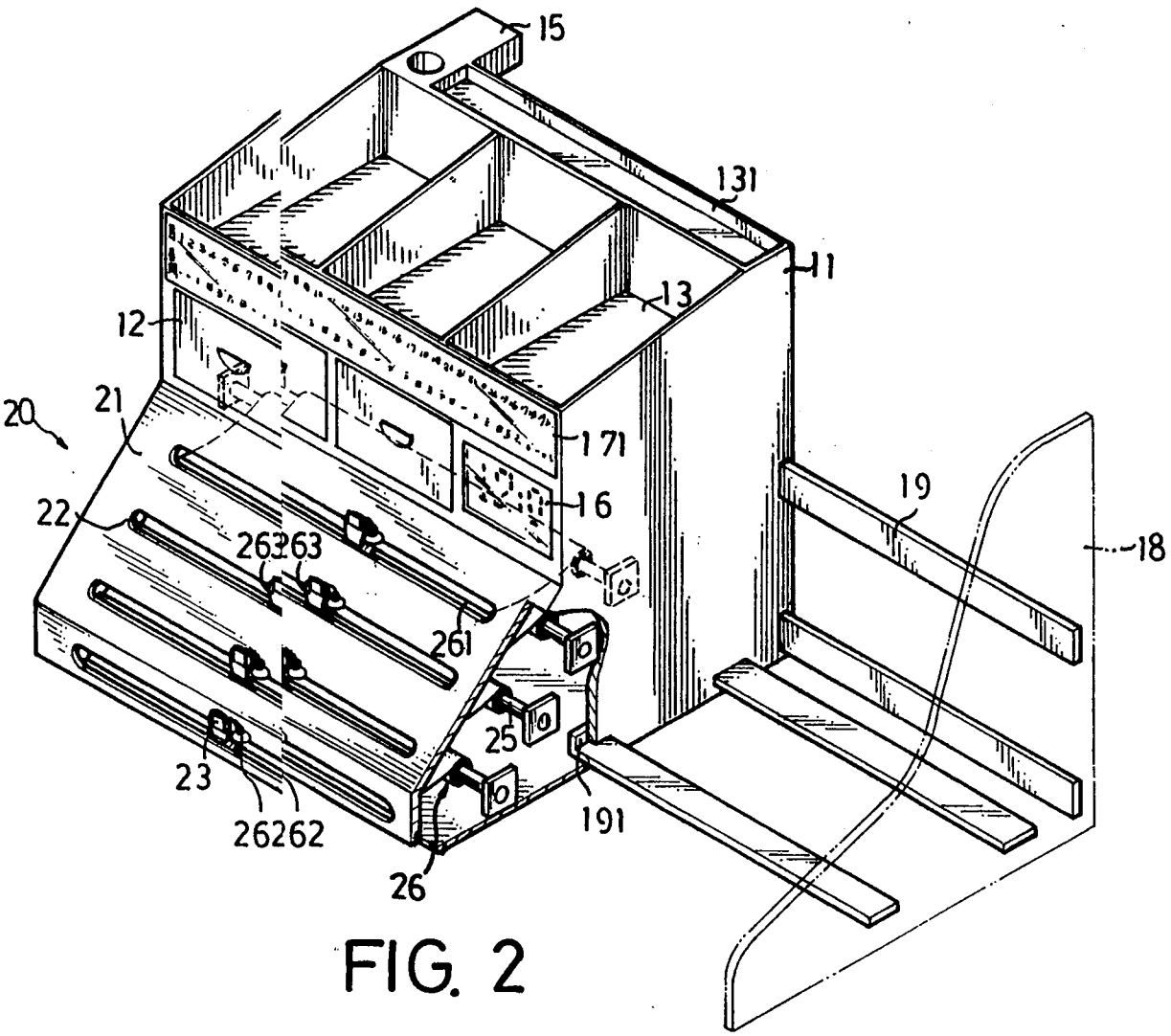
FIG. 2 is a perspective view of the stationery goods holder and book shelf combination, in which part of the holder is cut off for showing the interior of the holder.
Figure 3:
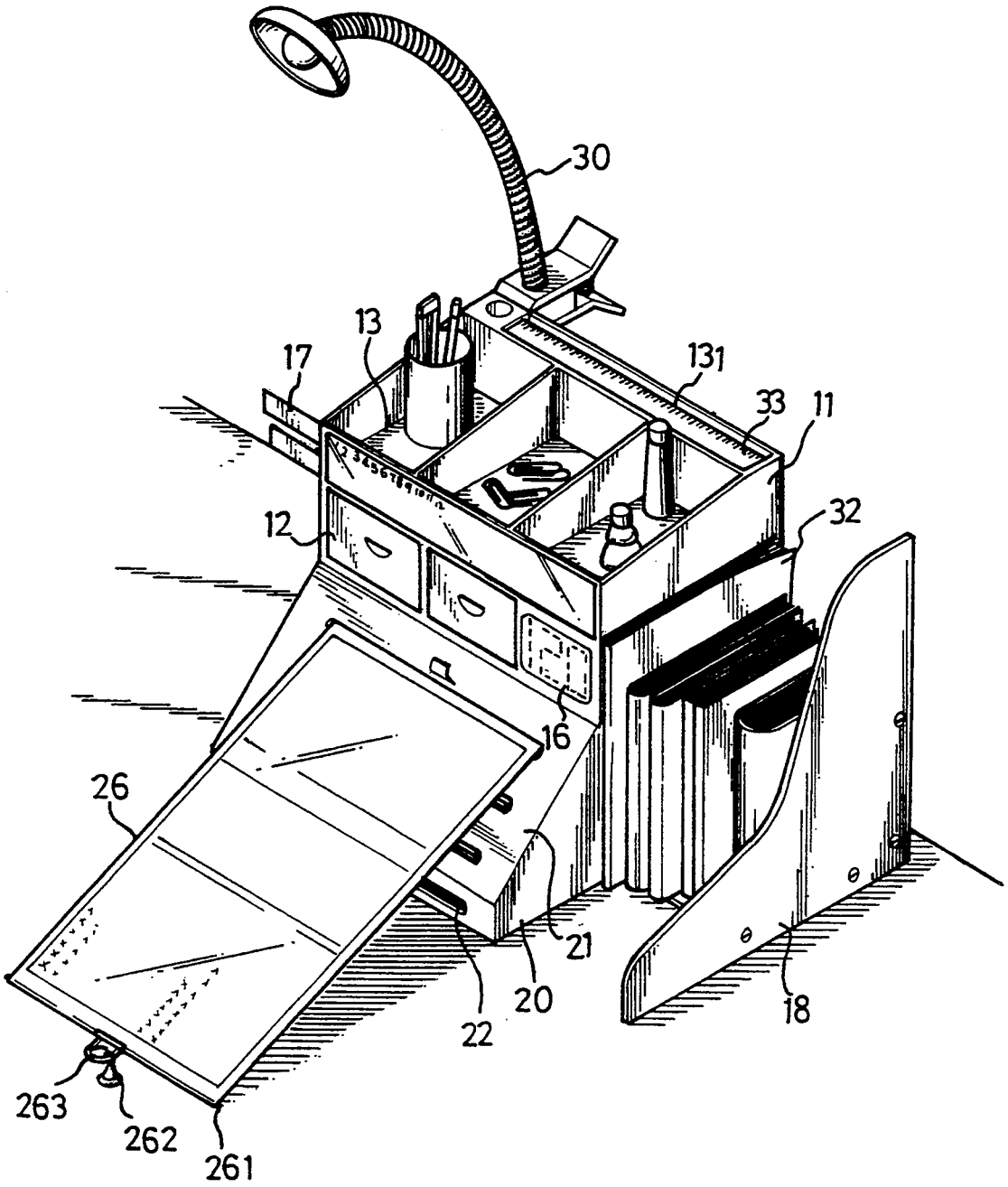
FIG. 3 is a perspective view of the stationery goods holder and book shelf combination illustrating the operation of the combination.

Referring to the drawings, a stationery goods holder and book shelf combination in accordance with the present invention comprises a housing 11 including three openings 13 formed in the top thereof for accommodating stationery goods, such as clippers, paper clips, rubbers, pins etc., a groove 131 formed in the top for receiving pens or rulers 33 (FIG. 3) or the like, an extension 15 extended rearward therefrom for attaching a lamp 30 (FIG. 3), two drawers 12 provided in the upper portion of the housing 11, a clock 16 disposed in the upper portion of the housing 11 and located beside the drawers 12, a typical calendar 171 and a pair of strips 17 provided in the upper portion of the housing 11 for indicating dates and days, a plurality of bars 19 laterally extended outward from the housing 11 and movable inwards of the housing 11, each of the bars 19 including a flange 191 formed in one end thereof for limiting the outward movement of the bars 19, and a stop 18 fixed to the other end of the bars 19 so as to form an expandable book shelf for holding books.

The housing 11 preferably includes a casing 20 provided in the lower portion thereof and extended forward of the housing 11, the casing 20 includes a front panel 21 having four slots 22 laterally formed therein, four shafts 25 rotatably supported in the casing 20 and the housing 11 and each having a sheet material 26 wound thereon, each of the sheet materials 26 includes a front edge extended outward through the slots 22 respectively and having a rod 261 engaged therein and a ring 263 and a suction cup 262 coupled thereto, a hook 23 is preferably provided above each of the slots 22 for engagement with the rings 263 respectively. The suction cups 262 may attached to the surface of the desk for supporting the housing 11 so as to retain the sheet materials 26 in the outward position. The users may write down notes on the sheet materials 26 when needed. It is preferable that the sheet materials 26 are rewritable materials which are commercially available.

Accordingly, the stationery goods holder and book shelf combination in accordance with the present invention includes a housing for accommodating stationery goods and a book shelf engaged to the housing for holding books, and a casing having at least one sheet material wound thereon, the sheet material can be pulled outward for taking notes. The stationery goods holder and book shelf combination includes a simplified configuration and a compact structure.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A combination comprising a housing including a top having at least one opening formed therein, at least one drawer provided in an upper portion of said housing for accommodating stationery goods, a plurality of bars laterally engaged in a side portion of said housing and each including a first end engaged in said housing and a second end extended outward of said housing, a board fixed to said second ends of said bars so as to form a book shelf, said housing including a front panel having at least one slot formed therein, a shaft rotatably supported in said housing, a sheet material wound on said shaft.

2. A combination according to claim 1 further comprising a rod engaged with said first edge of said sheet material, a ring and a suction cup engaged with said first edge so as to retain said sheet material in the outward extending position.

3. A combination comprising a housing including a top having further including a front panel having at least on slot formed therein, a shaft rotably supported in said housing at least one drawer provided in an upper portion of said housing for accommodating stationery goods, an extension extended from said top of said housing, a plurality of bars laterally engaged in a side portion of said housing and each including a first end engaged in said housing and a second end extended outward of said housing, a board fixed to said second ends of said bars so as to form a book shelf.

4. A combination according to claim 3, further comprising a sheet material wound on said shaft and including a first edge extended outward of said housing via said slot, said sheet material is pulled outward of said housing for taking notes.

5. A combination according to claim 4 further comprising a rod engaged with said first edge of said sheet material, a ring and a suction cup engaged with said first edge so as to retain said sheet material in the outward extending position.

* * * * *